US005413264A

United States Patent [19]

Kotzur et al.

[11] Patent Number: 5,413,264

[45] Date of Patent: May 9, 1995

[54] SERIAL ACCUMULATOR SYSTEM FOR FILAMENTARY MATERIAL

[75] Inventors: Frank W. Kotzur, Carmel; Mark Swanson, Mahopec; Kevin Sutton, Peekskill; Donald J. Hopko, Carmel; Thomas Rosenkranz, Dover Plains; David Franklin, Carmel, all of N.Y.

[73] Assignee: Windings, Inc., Patterson, N.Y.

[21] Appl. No.: 284,282

[22] Filed: Aug. 2, 1994

Related U.S. Application Data

[63] Continuation of Ser. No. 37,682, Mar. 25, 1993, abandoned, which is a continuation of Ser. No. 631,682, Dec. 24, 1990, abandoned.

[51] Int. Cl.[6] ..... B65H 20/24; G11B 15/56

[52] U.S. Cl. ..... 226/119; 226/118

[58] Field of Search ..... 226/118, 119, 108, 112, 226/113, 195; 242/475

[56] References Cited

U.S. PATENT DOCUMENTS

| | | | |
|---|---|---|---|
| 3,282,488 | 11/1966 | Bauer et al. | 226/195 |
| 3,381,868 | 5/1968 | Vogeler | 226/118 X |
| 3,501,076 | 3/1970 | Stuart et al. | 226/118 X |
| 3,540,641 | 11/1970 | Besnye | 226/1 |
| 3,568,946 | 3/1971 | Anderson | 242/47.5 X |
| 3,584,853 | 6/1971 | Munson | 226/118 X |
| 3,692,251 | 9/1972 | MeLead | 242/58.2 |
| 3,871,205 | 3/1975 | Fenton | 226/195 X |
| 4,058,265 | 11/1977 | Medlund et al. | 242/47.5 X |
| 4,202,476 | 5/1980 | Martin | 226/119 |
| 4,360,137 | 11/1982 | Noe et al. | 226/119 X |
| 4,398,677 | 8/1983 | Henrich | 242/47.5 X |
| 4,399,953 | 8/1983 | Macchia | 242/47.5 X |
| 4,771,621 | 9/1988 | Sato | 226/118 X |

*Primary Examiner*—Daniel P. Stodola
*Assistant Examiner*—William Stryjewski
*Attorney, Agent, or Firm*—Watson, Cole, Grindle & Watson

[57] ABSTRACT

A winding accumulator system for controlling the storage of filamentary material between a source of such material and a winding receptacle, utilizing: a plurality of serially interconnected accumulator units for storing filamentary material with the first accumulator unit receiving filamentary material from the source and storing a given amount of filamentary material and each succeeding accumulator unit storing double the amount of filamentary material stored by a preceding accumulator unit; varying the movement of the filamentary material between the accumulator units; and controlling the movement varying device to limit the change in tension of the filamentary material with changes in the acceleration or deceleration of the filamentary material caused by a change in the input or output of filamentary material to or from the accumulator system.

3 Claims, 6 Drawing Sheets

CAPSTAN 1
CAPSTAN 2
INPUT
OUTPUT
28
24
32
12
26
34
14
20
16
18
22
30
A
B
C
D
E
F
G
H
I
J
K
ACCUMULATOR 1
ACCUMULATOR 2
ACCUMULATOR 3

Vo
10.0
8.0
6.0
4.0
2.0
0.0
POSITION (FEET)
0.0
4.0
8.0
12.0
16.0
20.0
TIME (SEC.)

Vo
8.0
6.0
4.0
2.0
0.0
POSITION (FEET)
ACCUMULATOR 3
ACCUMULATOR 2
0.0
4.0
8.0
12.0
16.0
20.0
TIME (SEC.)

SERIAL ACCUMULATOR SYSTEM FOR FILAMENTARY MATERIAL

This application is a continuation of application Ser. No. 08/037,682, filed 25 Mar. 1993, now abandoned, which is a continuation of application Ser. No. 07/631,682, filed 24 Dec. 1990, now abandoned.

BACKGROUND OF THE INVENTION

1. Field of the Invention

This invention is directed to method and apparatus for accumulator systems for maintaining proper line tension during the winding of filamentary material such as wire or cable from a primary source of filamentary material such as the apparatus for making the filamentary material or a secondary source such as a spool of filamentary material, and more particularly to such apparatus and method using a plurality of serially connected active accumulator elements which are interdependently controlled from a programmed controller.

2. Related Art

U.S. Pat. No. 3,282,488 issued to Bauer et al. Nov. 1, 1966, discloses a web conveying apparatus using an overrunning clutch assembly geared to a dancer roll to power the vertical descent of the dancer roll and limit its descent speed in a system employing a plurality of rotary transport rolls engageable with a web to be transported.

U.S. Pat. No. 3,540,641 issued to Besnyo Nov. 17, 1970, relates to a web accumulator for maintaining a substantially uniform web tension in which a pair of opposed arms are mounted for swinging movement at opposite ends of a frame. A plurality of rollers are located at spaced intervals along the arms and the web is conducted alternately over a roller at the outer end of one arm and a roller at the inner end of the other arm and progressively back and forth over the rollers of both arms and then off the frame at the opposite end. The arms swing in coordinated relation to provide wide variation of spacing and the arms are powered to swing when the tension in the web changes.

U.S. Pat. No. 3,692,251 issued to Melead Sep. 19, 1972, discloses a tensioning apparatus used with winding and unwinding apparatus for thread-like filamentary material in which a roller is mounted for rotation in members disposed at the ends of the roller and supported by pivot arms, thereby enabling horizontal movement of the roller. The moving filamentary material engages the roller to apply a horizontal force opposite to a pre-determined desired horizontal force. Changes in the tension of the filamentary material cause horizontal motion of the roller and that motion adjusts tensions by changing the speed of the filamentary material.

U.S. Pat. No. 3,871,205 issued to Fenton Mar. 18, 1975, relates to apparatus for the length stabilization of armored well logging cable wherein the cable is passed from a payoff reel over hold-back sheaves, a series of fixed sheaves, a movable sheave, and haul-off sheaves to a take-up reel. A hydraulic system controls the movable sheave to place the cable under tension. A second hydraulic system cyclically varies the effect of the hold-back sheaves to vary the cable tension.

U.S. Pat. No. 4,202,476 issued to Martin May 13, 1980, discloses web-tensioning apparatus in which fixed web-driving rollers and idler rollers are suspended from the web. A first drive sets the surface velocity of a web-driving roller and a second drive sets the surface velocities of the other web-driving rollers in response to the positions of the idler rollers to maintain substantially uniform web tension.

There are essentially five different types of large capacity accumulators presently being used for winding filamentary material, and all of them have similar drawbacks or disadvantages, namely poor regulation of tension during acceleration and deceleration of the moving filamentary material. This is caused by the large moving mass of the accumulator, unresponsive air regulators, the time the volume of air requires to flow into the hydraulic cylinders and the inertia of the pulleys or sheaves.

The horizontally opening accumulator schematically shown in FIGS. 1A, 1B and 1C is normally mounted overhead and as the filamentary material slackens it becomes a safety hazard for the operators of the accumulator.

The vertical accumulator opening down as schematically shown in FIGS. 2A, 2B and 2C has a minimum tension during static conditions, i.e. when the movable block is stationary or the output speed of the filamentary material is equal to the input speed. Minimum tension is based upon gravity applying a force on the movable block. While this may be an advantage when the accumulator is filling with filamenatary material because gravity accelerates the block downward, it is also a disadvantage when filamentary material is being pulled out faster than it is being put in. Line tension increases during this dynamic change because the filamentary material must accelerate the movable block in the opposite direction of the gravitational force. Under static conditions the minimum tension of the filamentary material equals the weight of the movable block divided by the number of wraps.

The vertical accumulator opening up schematically shown in FIGS. 3A and 3B has one advantage in that it allows the operator to easily string the accumulator with the filamentary material. However, the tensioning system must also operate against gravity and when low tensions are desired there is not enough force to open the accumulator during filling of the filamentary material. This means complete failure of the accumulator. To close the accumulator the line tension must increase to move the block.

In the rotary type of accumulator schematically illustrated in FIGS. 4A and 4B, the inertia of the accumulator is its greatest disadvantage. During any speed change of the filamentary material, the material either becomes slack or high line tensions are applied.

The round accumulator that spreads open, which is schematically shown in FIGS. 5A and 5B, has a large mass so that it also has the same difficulties with controlling line tension as do the other accumulator types mentioned, supra.

SUMMARY OF THE INVENTION

In accordance with the invention, the accumulator system comprises a plurality of serially interconnected accumulator units and a programmed controller. The filamentary material capacity of each successive accumulator unit is double that of a preceding accumulator unit. Thus, in an accumulator system using three accumulator units, the first accumulator unit comprises a buffer/dancer, an accumulator and a motor-driven capstan with a total capacity of, for example, forty feet. The second accumulator unit comprises an accumulator, a motor- driven capstan and a twisted rod and potentiometer control with a total capacity of eighty feet. The third accumulator unit is essentially the same as the second accumulator unit but without a motor-driven capstan and with a total capacity of one hundred-sixty feet.

The primary object of the present invention is to provide an accumulator system which maintains proper line tensions and prevents problems induced by sluggish response to sudden starts, stops, accelerations and decelerations during the movement of filamentary material, and in particular during the winding of such material. With large capacity accumulators, for example 300 feet of filamentary material, sudden changes in line speed may cause excessive tension or cause the filamentary material to jump from the accumulator sheaves and tangle.

The above objects, features and advantages of the invention are essentially accomplished by the sequential action of a number of serially connected accumulator units. This enables the mass of the sheaves and blocks to be distributed over the number of accumulator units rather than being massed into one accumulator unit, thereby increasing the response time of these movable sheaves and blocks. A motor-driven capstan located between each series connected accumulator units controls the amount of filamentary material in a particular accumulator with which it is associated, and in turn is controlled by a programmed controller. The individual motor-driven capstans are controlled to minimize the movable block accelerations, which relates to tension in the filamentary material. The vertical accumulator opening down type has been chosen because it affords the best response to changes in the movement of the filamentary material after eliminating all the weight possible in the moving block and driving system.

BRIEF DESCRIPTION OF THE DRAWINGS

The above advantages, objects and features of the invention are believed to be apparent from the following description of an embodiment illustrative of the best mode of carrying out the invention when taken in conjunction with the drawings, wherein.

DETAILED DESCRIPTION

The primary principle of the present invention is that, for example, an accumulator for holding three hundred feet of filamentary material, such as cable or wire, is divided into a number of interconnected and interdependent units. This results in a significant lowering of the mass of each of the individual accumulator units, thereby reducing inertia and enabling quicker response of the moving sheaves of the individual accumulators. The following description is taken with respect to an exemplary accumulator control system employing three accumulators, it being understood that the principle of the invention is applicable to any number of cascaded accumulator units.

Figure 1A:
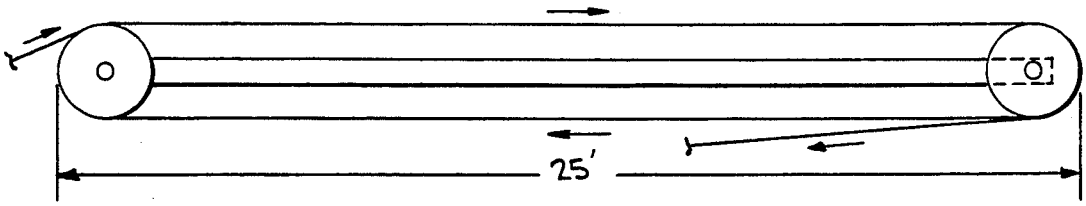
FIG. 1A (PRIOR ART)
FIGS. 1A, 1B and 1C illustrate a horizontal type accumulator of the prior art.
Figure 1B:
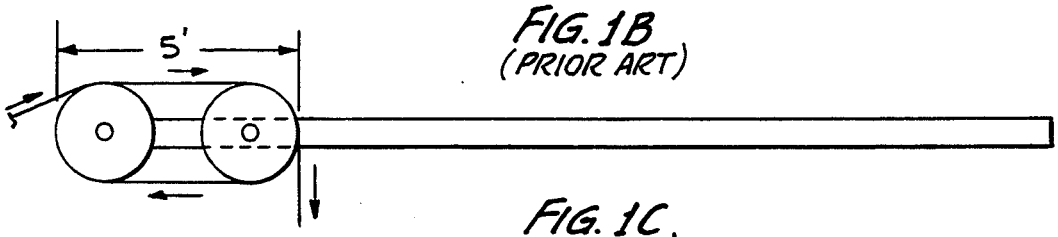
FIG. 1B (PRIOR ART)
Figure 1C:
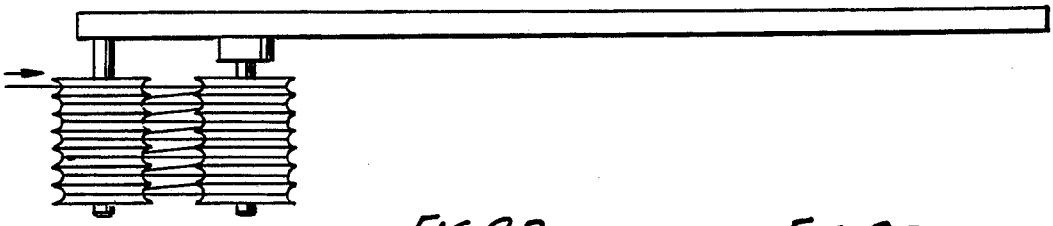
FIG. 1C (PRIOR ART)
Figure 2A:
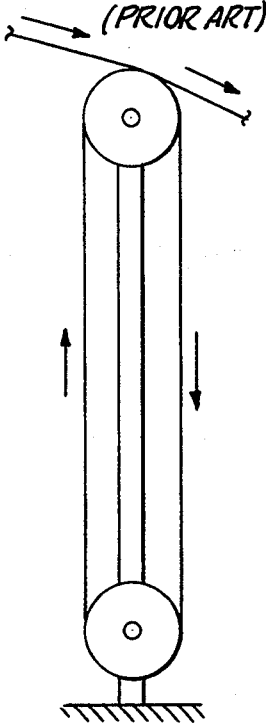
FIG. 2A (PRIOR ART)
FIGS. 2A, 2B and 2C illustrate a vertical opening down type accumulator of the prior art.
Figure 2B:
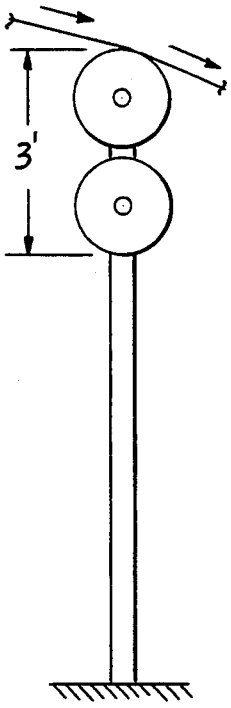
FIG. 2B (PRIOR ART)
Figure 2C:
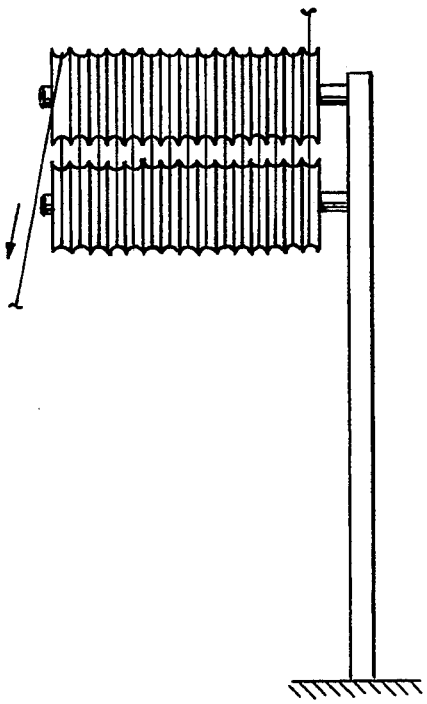
FIG. 2C (PRIOR ART)
Figure 3A:
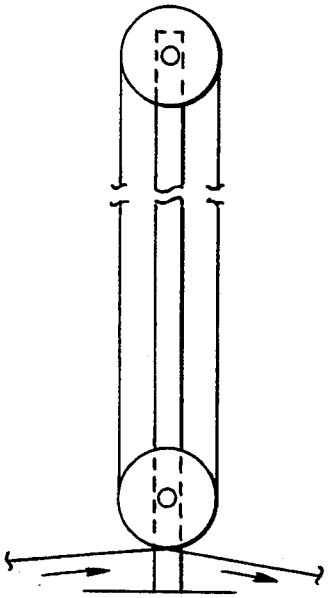
FIG. 3A (PRIOR ART)
FIGS. 3A and 3B show a vertical opening up type accumulator of the prior art.
Figure 3B:
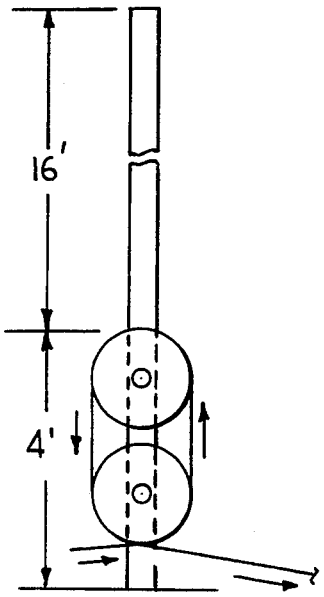
FIG. 3B (PRIOR ART)
Figure 5A:
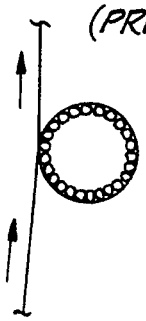
FIG. 5A (PRIOR ART)
FIGS. 5A and 5B illustrate a round that spreads open type accumulator of the prior art.
Figure 5B:
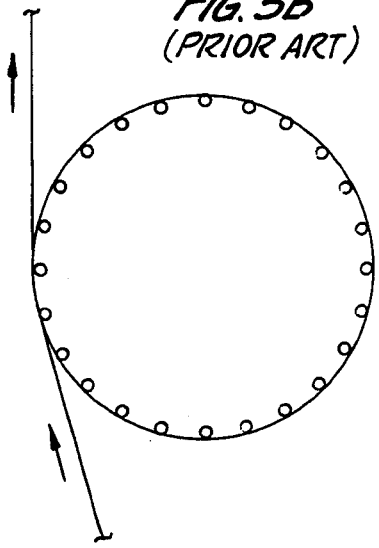
FIG. 5B (PRIOR ART)
Figure 4A:
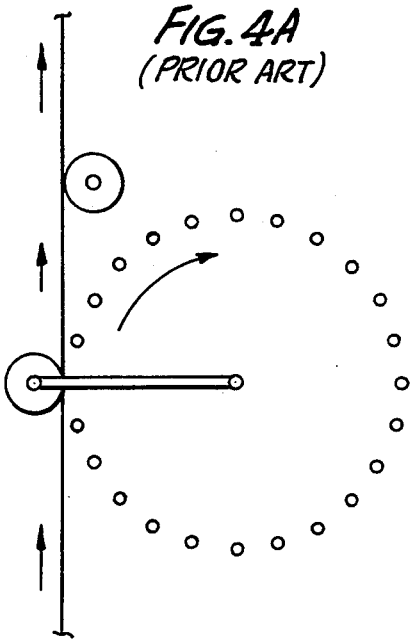
FIG. 4A (PRIOR ART)
FIGS. 4A and 4B show a rotary type accumulator of the prior art.
Figure 4B:
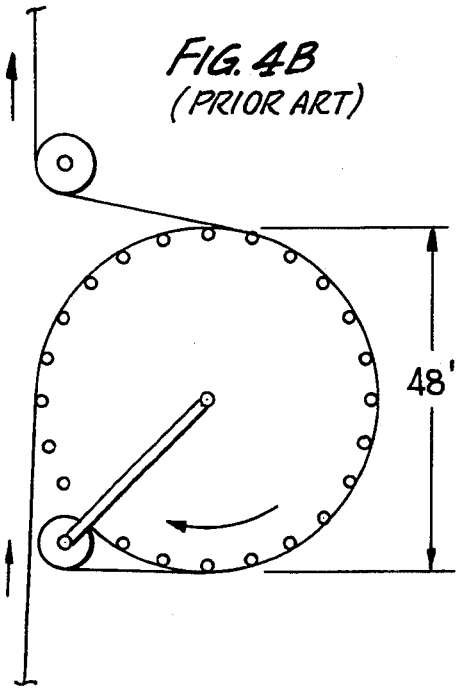
FIG. 4B (PRIOR ART)
Figure 6:
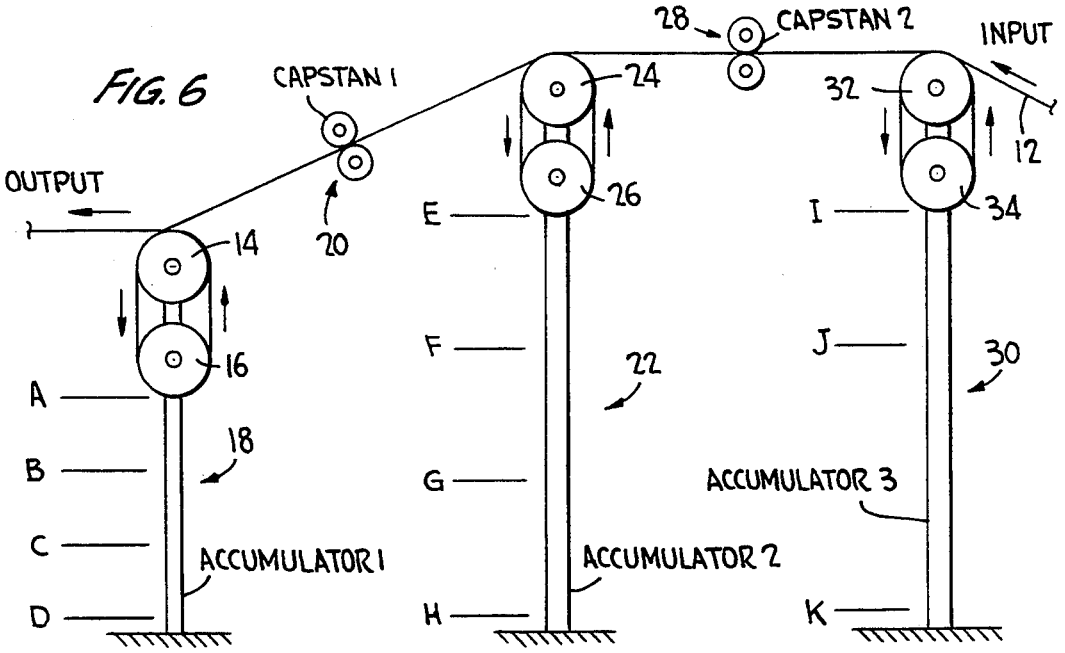
FIG. 6 is a side view of the layout of a winding accumulator control system with three accumulator units in accordance with the invention.

With reference to FIG. 6, the structure and operation of the three unit accumulator will be described from the output to the input. The first accumulator unit 18 comprises a three foot tall spring-loaded) buffer/dancer (not shown) with a total of five Derlin sheaves (three over two), an output guide (not shown), plus a six foot tall air-loaded accumulator 18 consisting of a stationary block 14 and a movable block 16, with a total of nine, nine inch aluminum sheaves (five over four), and a nine inch motor driven capstan 20. The filamentary material 12, such as wire or cable, is input from a source of filamentary material, such as a cable or wire spool, or directly from the line from which the filamentary material is manufactured, to stationary block 14 of first accumulator 18. The filamentary material is wound around the individual sheaves of stationary block 14 and moving block 16. Assuming the accumulator system is to have a total capacity of 300 feet of filamentary material, the capacity of the first accumulator unit 18 is forty feet.

In the foregoing description, the buffer/dancer is not essential and can be employed, for example, in an application in which the accumulator system of the invention is used in conjunction with a winding apparatus having a reciprocating traverse, such as disclosed in U.S. Pat. Nos. 4,406,419 and 4,477,033, both assigned to the same assignee as the subject invention. The buffer/dancer then provides a suitable buffer for feeding the filamentary material to the traverse mechanism of the winding apparatus. For applications other than the winding or re-winding of filamentary material the buffer/dancer is not necessary. The operation of such a buffer/dancer is conventional and known to those skilled in the art of winding filamentary material such that no further description of its structure is necessary for the purposes of this invention.

The second accumulator unit 22 comprises a ten foot tall accumulator, with an eight foot air-loaded cable cylinder with a stationary block 24 and movable block 26 with a total of fourteen, nine inch aluminum sheaves (seven over seven) and a nine inch motor driven capstan 28. The stationary block 24 and the sheaves therein are air piston-locked in position except during string-up when they can be lowered to simplify that operation. A string-up technique forming part of the present invention will be described hereinafter. The movable block 26 and sheaves are active using both gravity and the cable cylinder. The accumulator unit 22 has a total capacity of eighty feet of filamentary material.

Third accumulator unit 30, comprising stationary block 32 and movable block 34, is approximately 10 feet tall and the same as the second accumulator unit 22, with the exception that there are twenty seven, nine inch aluminum sheaves (fourteen over thirteen). The third accumulator unit 30 has a total capacity of one hundred sixty feet. The filamentary material enters the third accumulator 30 from a source of filamentary material such as wire or cable spool, or the production line which actually produces the filamentary material.

In practice, the second and third accumulator units 22 and 30 are preferably mounted on one ten foot tall steel channel. However, in some applications, for example where there is a long distance between the source of filamentary material and the third accumulator unit, the accumulator units may be spread out and separated as indicated in FIG. 6. The potentiometer controls for the motor driven capstans are preferably wall mounted or mounted in a separate control cabinet.

The operation of the accumulator system of the invention is as follows. After the individual accumulators have been strung-up, the first accumulator 18 is at position A, the second accumulator 22 is at position E and the third accumulator 30 is at position I. All of the line speeds are the same at all points, namely the output, input capstan 20 and capstan 28 speed. Assume that the filamentary material line speed is one thousand ft/min., and if the output goes to zero, capstans 20 and 28 still operate at one thousand ft/min. Thus the first accumulator 18 starts to fill until it is at a position B, then capstan 20 decelerates and stops when the first accumulator 18 is at position D. As capstan 20 starts to decelerate, the second accumulator 22 starts to fill. When the second accumulator 22 reaches position F, capstan 28 decelerates and the second accumulator 30 starts to fill. When the second accumulator 22 is at position H capstan 28 is stopped. The third accumulator 30 is now taking up the filamentary material at one thousand ft/min. which is equal to the input of filamentary material at the first accumulator unit 18. The output of filamentary material must begin before the third accumulator unit 30 is at position K. As the output of filamentary material increases to more than one thousand ft/min., the first accumulator unit 18 empties. As this occurs, the first capstan 20 accelerates to more than one thousand ft/min. The first accumulator 18 stops emptying at position C. The second accumulator unit 22 empties and the second capstan 28 starts feeding cable into the second accumulator 22. The third accumulator unit 30 decelerates and stops as capstan 28 reaches one thousand ft/min. The second accumulator unit 22 will be at position G when capstan 28 is driven at one thousand ft/min. As soon as the second accumulator unit 22 goes above position G, capstan 28 will go over one thousand ft/min., which causes the third accumulator unit 30 to start closing. When the third accumulator unit 30 reaches position J, capstan 28 is decelerated to one thousand ft/min. When the third accumulator 30 is back to position I, capstan 28 is going at one thousand ft/min. and the second accumulator unit 22 will finish emptying. When the second accumulator 22 is at position E, capstan 20 is going at one thousand ft/min. Therefore, the first accumulator 18 finishes emptying until it reaches position A and the operation of the accumulator system is back to where it started. It is noted that the device taking up the cable at the output of the accumulator system is controlled by the position of the first accumulator 18, as that accumulator unit empties the takeup to match line speed.

Figure 7:
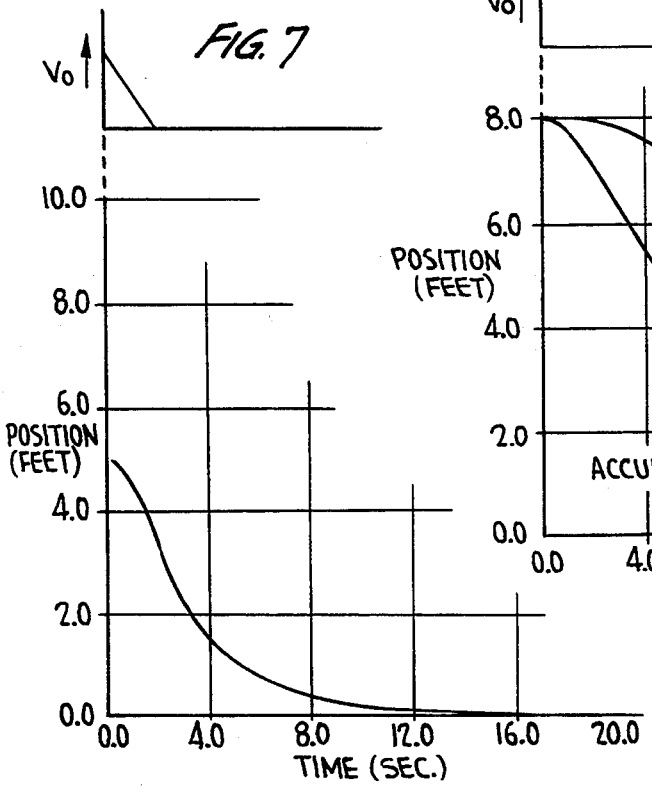
FIGS. 7 and 8 illustrate graphs of the position of the accumulators of FIG. 6 with respect to time to explain the operation of the winding control system of the invention.
Figure 8:
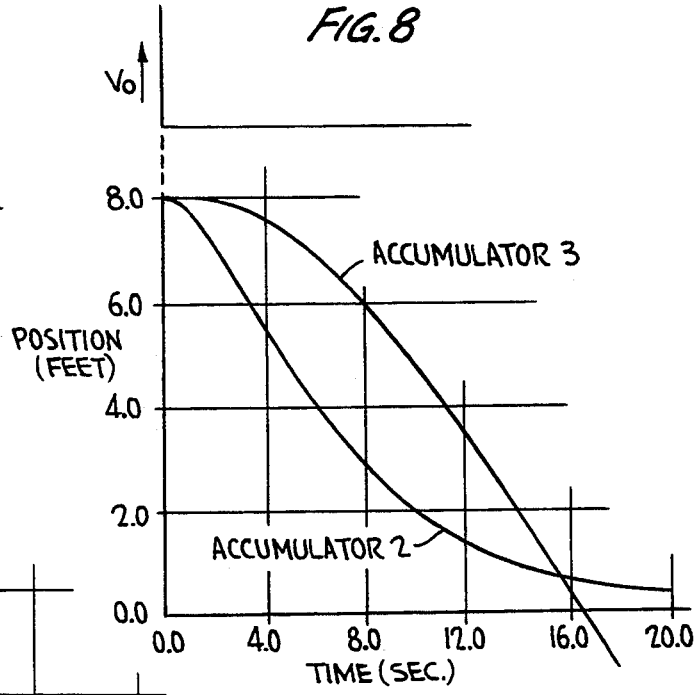

The significant advantages of the above structure and operation is as follows. The first accumulator unit 18 accelerates to speed in approximately one second as is shown in FIG. 7 as it has the lightest weight. As shown in FIG. 8, the second accumulator unit 22 accelerates to one thousand ft/min. in 2 seconds as it is heavier than the first accumulator unit 18. The third accumulator unit 30 accelerates to the required speed of one thousand ft/min. in four seconds. Therefore the tension during dynamic changes in the accumulator system is controlled. It is to be noted that the decelerations of the first and second accumulator units 22 and 30 are exponential.

Figure 9B:
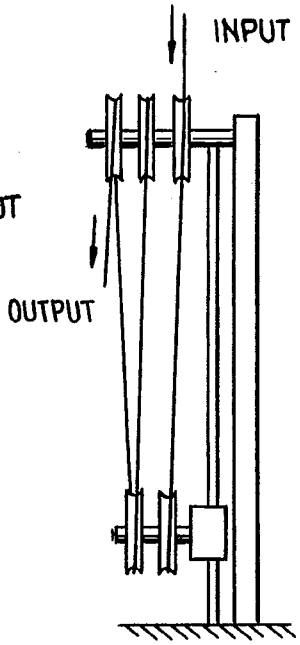
FIGS. 9A and 9B show the sheaves of a typical accumulator unit for demonstrating the effects of inertia on the movement of the sheaves within an accumulator unit.
Figure 9A:
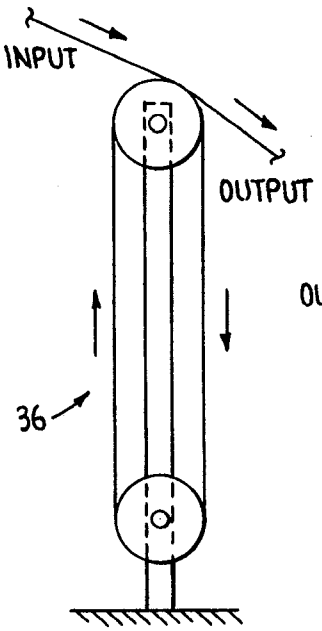

The inertia of the sheaves is another aspect of accumulator operation that has not been fully addressed by the prior art accumulator systems. With respect to FIGS. 9A and 9B, if no cable is entering the accumulator 36 and the output is not accelerating, sheave E must rotationally accelerate with the output. Sheave A will not rotate, so no acceleration occurs. Sheave B will accelerate at $\frac{1}{4}$ the rate of acceleration of sheave E. Sheave C will accelerate at $\frac{1}{2}$ the rate of acceleration of sheave E and sheave D will accelerate at $\frac{3}{4}$ the rate of acceleration of sheave E. The tension will therefore be different for each wrap of the material. The cable from sheave A to B will be different from that of B to C, etc. Each sheave is accelerated at a different rate. If the sheaves have high inertia, then two stands can hold the entire weight of the blocks for a short duration of time. This creates a high tension impulse on the cable which may damage it. Such an effect is compounded by the addition of more sheaves. The aforementioned effects can be decreased by using sheaves with the lowest inertia available.

Figure 10C:
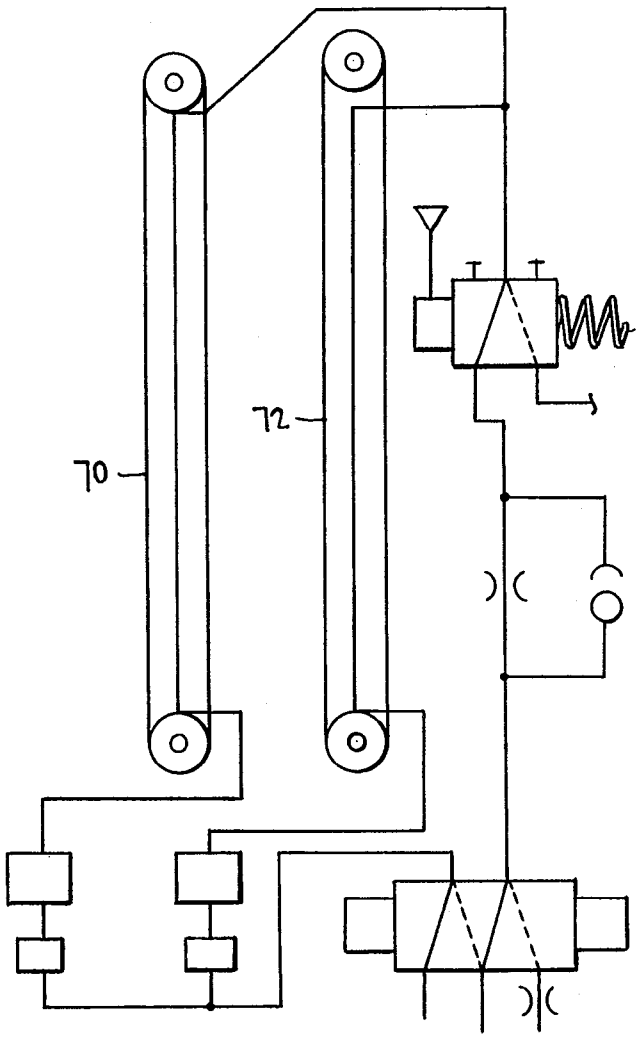
FIG. 10C is a diagrammatic representation of the pnuematic circuitry for controlling the position of the cable cylinders and sheaves of each of the accumulator units.
Figures 10A, 10B:
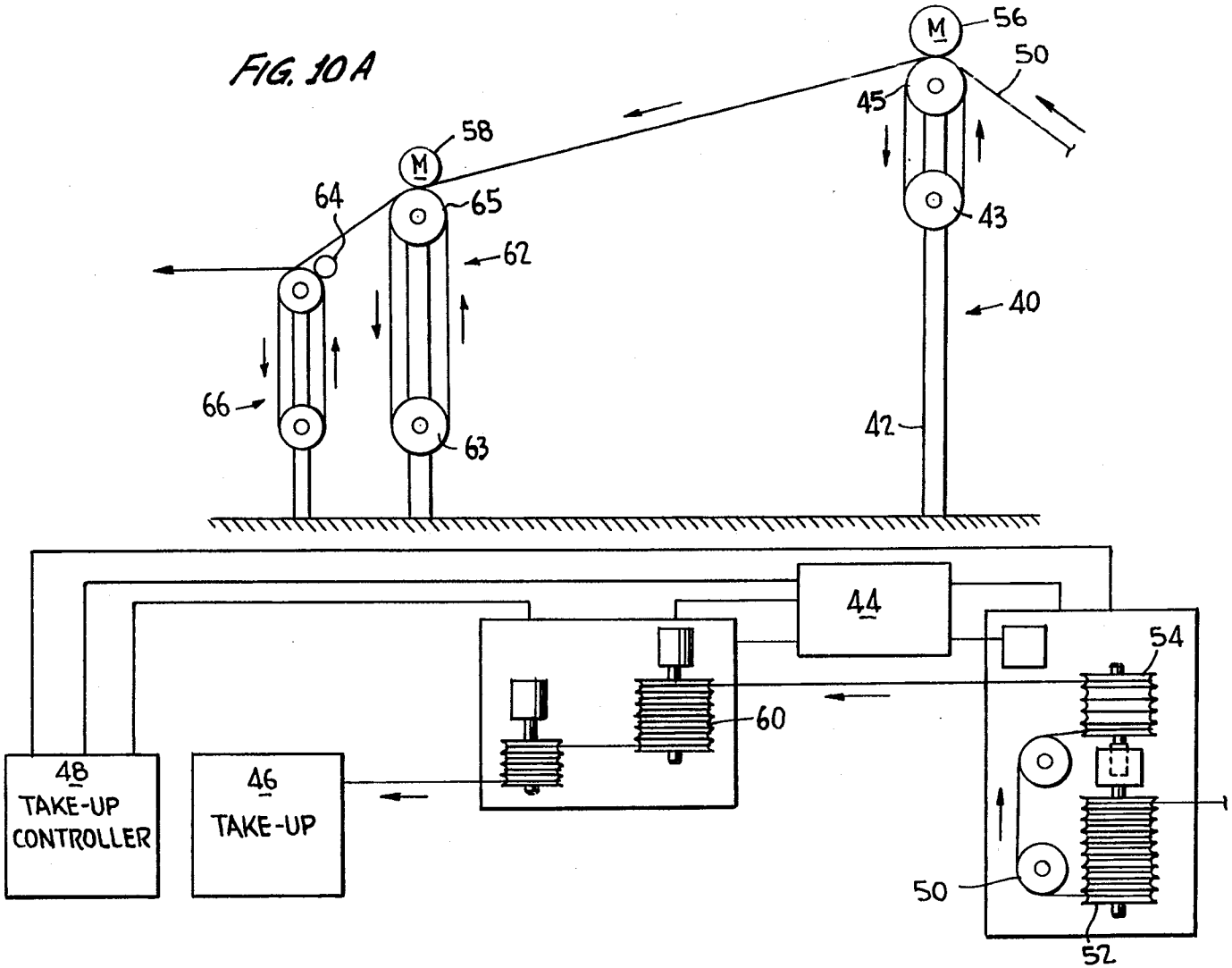
FIGS. 10A and 10B are combined schematics and block diagrams showing the interconnection of the accumulator units of a second preferred embodiment of the invention and the controller circuitry.

In a preferred embodiment of the invention, the second and third accumulators are constructed on one support beam as shown in FIG. 10A. As mentioned, supra., such a construction is useful when there is a relatively short distance between the source of the filamentary material and the input to the accumulator system. But if there is such a distance between the source of filamentary material and the input of the accumulator system that the filamentary system sags, then the configuration of FIG. 6 is preferred where the second and third accumulator units are mounted on separate supports. Long spans of filamentary material that result in sagging tend to produce undesired oscillations in the system.

In the accumulator system of FIG. 10A, the second and third accumulators 40 are mounted on the same beam 42 in side-by-side relationship as is clear from FIG. 10B, which is a top view of the individual accumulator units with the accumulator controller 44, take-up unit 46 and take-up controller 48 also illustrated. The take-up unit 46 and take-up controller 48 form no part of the present invention and therefore no further description of their respective structure and operation is necessary for the purposes of this invention. The filamentary material 50 is strung on the individual sheaves 52, 54 of accumulator units 2 and 3 and motor driven capstan 56 and then to motor driven capstan 58 and then strung around the individual sheaves 60 of the first accumulator unit 62, through footage counter wheel 64 and then strung around the buffer/dancer unit 66. The buffer/dancer 66 enables the accumulator system to adjust to the reciprocating motion of a traverse on a rewinding apparatus, and thus the configuration of the accumulator system shown in FIG. 10A is suitable for operation with a rewinding apparatus such as that disclosed in U.S. Pat. Nos. 4,406,419 and 4,477,033, both assigned to the same assignee as the present invention.

The accumlator systems of FIGS. 6 and 10A are strung up by lowering the lower sheaves 26 and 34 of accumulator units 22 and 30 (FIG. 6) and lowers sheaves 43 and 63 of FIG. 10A by depression of a "String-Up" button on the controller. This automatically raises the cable cylinder cables to the topmost position, thus preventing free fall of the upper sheaves 24 and 32 of FIG. 6 and 45 and 65 of FIG. 10A. The dead-bolt locks (not shown) that hold the top sheaves in their normal operating position are released. The top sheaves 24 and 32 of FIG. 6 and 45 and 65 of FIG. 10A are slowly lowered by bleeding air out of the air cylinder (to be described more fully hereinafter) until the top sheave block is resting on the bottom sheave block. After the filamentary material, such as cable or wire, has been strung up, the top sheaves are returned to their normal operating positions by the cable cylinders, the dead bolts are locked in place and the cable cylinder cables are returned to the bottom so that they can exert downward force on the lower sheaves. FIG. 10C is a block diagram representation of the pneumatic system for controlling the cable cylinders 70, 72.

Figure 11:
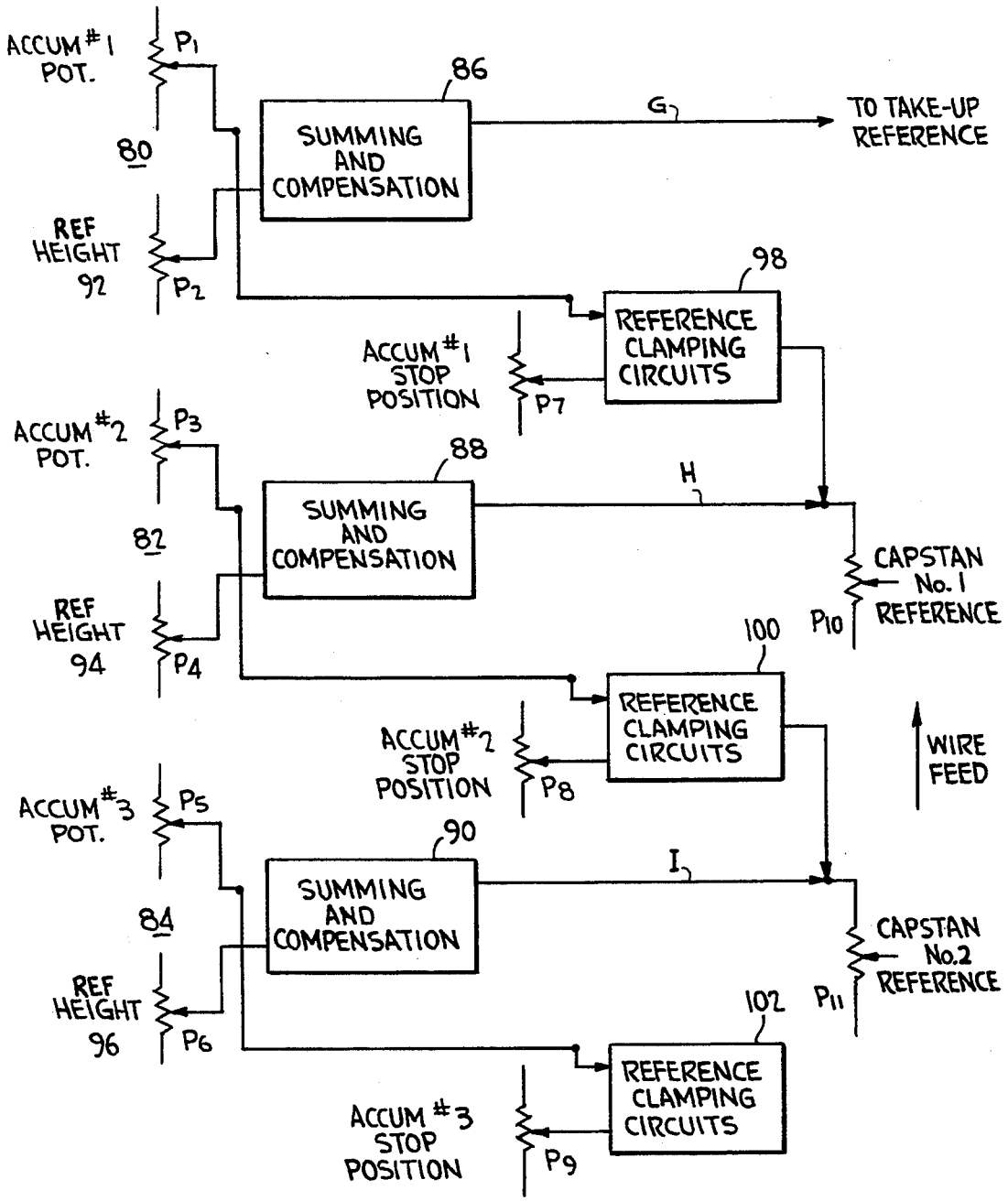
FIG. 11 shows a combined block and schematic of the capstan controller circuitry.

FIG. 11 illustrates, in combined schematic and block diagrammatic format, the essential circuitry for controlling the motor driven capstans to feed the filamentary material through the accumulator system of the invention. Referring to FIG. 6, for each capstan 1 and 2, with the downstream accumulator more empty than a predetermined amount, that capstan runs at a speed that is proportional to the amount of filamentary material in the upstream accumulator. However, once the downstream accumulator fills beyond a preset amount, the capstan speed is inversely proportional to the amount of filament in the downstream accumulator until it is full (the accumulator stop position) regardless of the amount of filamentary material in the upstream accumulator. Since the upstream accumulator is no longer in control of the (downstream) capstan and since the speed of the upstream capstan is still controlled by the accumulator still further upstream, the accumulator between the two capstans must begin to accumulate filamentary material.

REDUCTION AND INCREASE OF INPUT SPEED

If the input speed and output speed of filamentary material in the accumulator system are equal, all three accumulators are shown in their approximate correct running positions in FIG. 6. However, if the input speed of the filamentary material is reduced, ACCUMULATOR 3 begins to empty (because the input and output speeds of the accumulator are not equal) causing CAPSTAN 2 to slow down. This causes ACCUMULATOR 2 begin emptying thereby causing the final take-up device to reduce speed. If the input speed of the filamentary material is increased, the reverse operation of that described above occurs.

REDUCTION OF OUTPUT SPEED

If the output speed is reduced to zero (or simply reduced), ACCUMULATOR 1 begins to fill with filamentary material. Once that accumulator fills to level A, the speed of CAPSTAN 1 is reduced by the reference clamping circuits 98 of FIG. 11 until the speed of that capstan reduces zero when ACCUMULATOR 1 reaches position D (FIG. 6). As the speed of CAPSTAN 1 is reduced, ACCUMULATOR 2 must begin to fill with filamentary material because:

(1) Accumulator 2 no longer controls the speed of the capstan 1; and (2) the input speed is higher than the output speed of the accumulator.

Once ACCUMULATOR #2 fills to level E (FIG. 6), the speed of CAPSTAN 2 is reduced by the reference clamping circuits 100 (FIG. 11) until it reaches zero when ACCUMULATOR 2 reaches position H. As the speed of CAPSTAN 2 is reduced ACCUMULATOR 3 must begin to fill. The input speed can come from another capstan and accumulator, or can come from the end of the filamentary material manufacturing process.

RESUMPTION OF OUT SPEED

When the output speed is resumed to its previous level, the accumulators will stop filling. Normally, however, the output speed is increased to a value higher than the input speed. This is automatic because the full condition of ACCUMULATOR 1 causes the take-up device to run at full speed. This, in turn, causes ACCUMULATOR 1 to empty causing CAPSTAN 1 to increase speed. This will, in turn, cause ACCUMULATOR 2 to begin to empty causing CAPSTAN 2 to increase speed. This will cause ACCUMULATOR 3 to begin to empty. The result of this is that the speed of the filament leaving ACCUMULATOR 3 will be faster than the filamentary material entering that accumulator. As ACCUMULATORS 1, 2 and 3 empty past positions A, B, C (FIG. 6), respectively, the respective reference clamping circuits release the summing and compensating circuits to control the capstans. The respective first, second and third accumlator unit potentiometers, namely ACCUM #1 POT, ACCUM #2 POT and ACCUM #3 POT provide information as to the actual position (height) of the movable blocks 16, 26, and 34 in each of the respective ACCUMULATOR 1, ACCUMULATOR 2 AND ACCUMULATOR 3 units (FIG. 6) and which information, along with the respective reference height of movable blocks 16, 26 and 34, is input to respective summing and compensation circuits 86, 88 and 90. Each of the summing and compensation circuits 86, 88 and 90 provide properly compensated error signals of the first and second capstans and the final take up by using the settings of each of the accumulator potentiometers ACCUM #1 POT ACUM #2 POT and ACCUM #3 and the respective associated height adjust potentiometers 92, 94 and 96. The respective reference clamping circuits 98, 100 and 102 adjust the output of each of the respective ACCUM #1 POT, ACCUM #2 POT AND ACCUM #3 POT, with respect to respective signals from ACCUM #1 STOP POSITION, ACCUM #2 STOP POSITION and ACCUM #3 STOP POSITION potentiometers, the respective outputs of the latter potentiometers being input respectively to Reference clamping circuits 98, 100, and 102, when certain conditions are met as described above with respect to FIG. 6 in the operation of the accumulator system. For example, even though the reference signal H from summing and compensation circuit 88 is calling for a speed of nine hundred ft/min., the output of reference clamping circuit 98 may be reducing that speed because the position of the first accumulator is no longer near its normal running height because the take up is stopped. This would cause the second accumulator to begin falling because the output of reference clamping circuit 98 is controlling the first motor driven CAPSTAN 1 to go slower. And, even though the third accumulator is at its normal running height providing a reference signal I for 900 ft/min., reference clamping circuit 100 will begin reducing signal I because the second accumulator unit is no longer at its initial height. It is clear from the foregoing description that reference clamping circuits 98, 100 and 102 modify the respective outputs from summing and compensation circuits 88 and 90 to provide proper motor control signals to capstans 1 and 2 so that the capstans are either caused to accelerate, decelerate or stop to maintain the necessary wire feed speed so that the wire stored in each of the accumulators #1, #2 and #3 will remain within the required limits to prevent the respect moving blocks in each of the accumulators from reaching the floor or to jam up against the respective upper stationary blocks, either of which occurrence would result in an undesired interruption in the feeding of wire to the take-up apparatus or in the feeding of wire from the input apparatus. Additional cascaded circuits can be provided for additional accumulator units if necessary, such that the accumulator control system of the invention is not limited to the three accumulator units described herein for purposes of explaining the structure and operation of the accumulator control system. Thus, the invention is not intended to be limited by the foregoing description, but by the following claims and the equivalents to which the claimed subject matter is entitled.

What is claimed is:

1. A winding accumulator system for controlling the storage of filamentary material between a source of such material and a winding receptacle, comprising:

a plurality of serially interconnected accumulator units, each including means for storing filamentary material with a first accumulator unit receiving filamentary material from said source and storing a given amount of filamentary material, and each succeeding accumulator unit storing additional amounts of filamentary material, each of the accumulator units includes a stationary block and a movable block for storing said filamentary material, whereby movement of said movable block away from and toward said stationary block respectively increases or decreases the amount of filamentary material stored in the accumulator unit;

a capstan and associated capstan motor positioned between adjacent accumulator units for controlling the movement of filamentary material between the adjacent accumulator units;

means for controlling the rotation of each of the capstan motors to vary the amount of said filamentary material stored in the adjacent accumulator units with changes in the acceleration and decceleration of said filamentary material caused by a change in the input or output of filamentary material in the winding accumulator system; said means for controlling including:

means for sensing a desired reference amount of filamentary material stored in each of said accumulator units;

means for determining the change in the amount of filamentary material stored in each of said accumulator units;

said means for controlling further including means for generating respective compensation signals from the change in the amount of filamentary material in each of the adjacent accumulator units to control each respective capstan motor; and said means for controlling further including reference clamping circuits for at least one of decreasing and increasing the respective capstan motor control compensating signals from two of said means for generating associated with adjacent accumulator units to control the capstan motor between said two adjacent accumulator units.

2. The winding accumulator system as set forth in claim 1, further comprising buffer/dancer means for receiving the filamentary material output from the last of the accumulator units to enable adjustment of the accumulator system to changes in the input of filamentary material in the winding receptacle.

3. The winding accumulator system as set forth in claim 1, wherein said means for controlling further includes respective means for determining the position of the movable block in each of the accumulator units, respective summing and compensation circuits responsive to the respective position determining means for generating respective compensated error signals, and respective reference clamping circuits for adjusting the output of a respective summing and compensation circuit in accordance with the position of the movable block of an adjacent upstream accumulator unit.

* * * * *